US011787221B2

(12) United States Patent
Petratou et al.

(10) Patent No.: US 11,787,221 B2
(45) Date of Patent: Oct. 17, 2023

(54) WRITING INSTRUMENTS

(71) Applicants: Société BIC, Clichy (FR); BIC Violex S.A., Anoixi (GR)

(72) Inventors: Eirini Petratou, Clichy (FR); Nikolaos Chatzigrigoriou, Anoixi (GR)

(73) Assignees: Soceté BIC, Clichy (FR); BIC Violex Single Member S.A., Anoixi (GR)

( * ) Notice: Subject to any disclaimer, the term of this patent is extended or adjusted under 35 U.S.C. 154(b) by 0 days.

(21) Appl. No.: 17/451,274

(22) Filed: Oct. 18, 2021

(65) Prior Publication Data

US 2022/0134796 A1 May 5, 2022

(30) Foreign Application Priority Data

Oct. 29, 2020 (EP) ..... 20315439

(51) Int. Cl.
*B43K 23/12* (2006.01)
*B43K 25/02* (2006.01)

(52) U.S. Cl.
CPC ..... *B43K 23/126* (2013.01); *B43K 25/022* (2013.01)

(58) Field of Classification Search
CPC .... B43K 23/12; B43K 23/122; B43K 23/124; B43K 23/126; B43K 23/128; B43K 25/022
See application file for complete search history.

(56) References Cited

U.S. PATENT DOCUMENTS 4,765,767 A * 8/1988 Marynissen ..... B43K 25/02 24/11 F
7,131,785 B1 * 11/2006 Mansouri ..... B43K 29/00 401/243
2012/0246880 A1 * 10/2012 Ootsuka ..... B43K 29/02 24/11 R
2013/0038579 A1 * 2/2013 Boyd ..... B43K 1/00 345/179
2015/0022503 A1 1/2015 Chang et al.

FOREIGN PATENT DOCUMENTS

| | | | |
|---|---|---|---|
| GB | 2401827 | A | 11/2004 |
| JP | 3797286 | B2 | 7/2006 |
| WO | 2004009374 | A2 | 1/2004 |

OTHER PUBLICATIONS

European Search Report issued in EP 20315439.8 dated Mar. 25, 2021 (9 pages).

* cited by examiner

*Primary Examiner* — David P Angwin
*Assistant Examiner* — Bradley S Oliver
(74) *Attorney, Agent, or Firm* — Bookoff McAndrews, PLLC

(57) ABSTRACT

A writing instrument according to the present disclosure comprises a main body, a writing tip and a cap, wherein the cap is designed to be secured tightly on the main body such that the writing tip is covered by the cap. The cap comprises of an inner core and an outer layer, wherein a material of the outer layer is softer compared to a material of the inner core. With that, it is possible to design an air-tight (or almost air-tight) fitting cap for a writing instrument. With the softer outer layer of the cap, it is achieved that a user chewing on the cap has a reduced risk of damaging his/her teeth. In addition, although a membrane within the cap may still be present, such membrane is no longer necessary. The membrane may be an additional barrier contributing further to the air-tight effect of the cap that is present within the cap.

20 Claims, 2 Drawing Sheets

WRITING INSTRUMENTS

CROSS REFERENCE TO RELATED APPLICATION(S)

This application claims benefit from European patent application EP20315439.8 filed on 29 Oct. 2020, its content being incorporated herein by reference.

FIELD

The present disclosure relates to writing instruments, in particular pens or markers comprising a cap made of two components.

BACKGROUND

A writing instrument cap providing a sealed end comprising a membrane is known from WO 2004/009374 A2. The membrane within the cap implements a slit, forming a substantially airtight seal, when the nib is within the seal and when the nib protrudes through the slit.

A chewable writing instrument comprising a body having a hollow cylindrical shaft and at least one cap is described in U.S. Pat. No. 7,131,785 B1. The cap is connectible to the body and the distal end of the body, allowing the cap to be chewed on upon connection to the end of the body.

The object of the present disclosure is to provide a writing instrument comprising an airtight or almost airtight cap made of two components. Another object of the present disclosure is to provide a writing instrument cap with improved safety.

SUMMARY

The present disclosure relates to a writing instrument as defined in claim 1. The dependent embodiments depict embodiments of the present disclosure.

A writing instrument according to the present disclosure comprises a main body, a writing tip and a cap, wherein the cap is designed to be secured tightly on the main body such that the writing tip is covered by the cap. The cap comprises of an inner core and an outer layer, wherein a material of the outer layer is softer compared to a material of the inner core or the material of the outer layer or exhibits a shore A hardness value that is higher compared to the material of the inner core. With that, it is possible to design an air-tight (or almost air-tight) fitting cap for a writing instrument. With the softer outer layer of the cap, it is achieved that a user chewing on the cap has a reduced risk of damaging his/her teeth. In addition, although a membrane within the cap may still be present, such membrane is no longer necessary. The membrane may be an additional barrier contributing further to the air-tight effect of the cap that is present within the cap.

The writing instrument further comprises at least one cartridge containing an ink, a colorant, or a mixture of ink or colorant and a solvent. The writing tip may be designed as a ballpoint tip, a felt tip, a fountain tip or any other type of tip such as pencil tip or a graphene tip. The outer layer may have the same color as the ink or colorant of the writing instrument.

The inner core of the cap and the main body of the writing instrument are designed to form an air-tight or almost air-tight connection in order to encapsulate the writing tip, such that it prevents or reduces evaporation of the solvent, ink or colorant when volatile, as well as prevent breakage of the writing tip. This ensures the writing tip is protected from drying and the evaporation of possibly harmful substances is prevented or at least reduced. In some embodiments, the inner core of the cap may consist of two inner compartments/spaces, being separated. One compartment/space may seal the writing tip in order to prevent evaporation of the ink and the other compartment/space may be configured to have openings to allow air to flow in the unfortunate circumstance that the cap is swallowed.

The inner core of the cap is made of a rigid plastic material, in particular a hard plastic, providing tight tolerances to seal with the main body of the writing instrument. Thus, the cap can be firmly attached with the writing body, averting the cap from being displaced easily and get lost. Throughout the present description and claims, a hard plastic should be understood as a thermoplastic material, such as semicrystalline polymer and/or amorphous polymer and/or mixtures thereof, more specifically a semicrystalline polymer or mixtures thereof. In particular, semi-crystalline materials have a highly ordered molecular structure with sharp melt temperature (phase transition temperature). They do not gradually soften with a temperature increase, instead, semicrystalline materials remain solid until a given quantity of heat is absorbed and then rapidly change into a low viscosity liquid. In contraposition, an amorphous material does not have a well-defined phase transition temperature (melt temperature) which would thus make difficult to control and predict its behavior during manufacturing process. The defined phase transition temperature (melt temperature) is intrinsic property of the material and depends on the material type. In particular, the melt temperature of the hard plastic, more specifically of the semicrystalline polymer should be of at least 100° C. The defined-phase transition temperature (melt temperature) of a semicrystalline polymer allows the material to exhibit heat stability and dimensional stability/integrity. This fact contributes to the plastic material used as inner core of the cap to be stable during manufacturing process by keeping its dimensions, compared to an amorphous material. The use of a hard plastic material as the inner core material of the cap of the writing instrument contributes to maintaining its dimensions during the manufacturing process and the conditions applied, as well as leading to the production of an inner core that is dimensionally determined and solid allowing firm attachment and/or sealing of the main body of the writing instrument.

The material of the inner core of the cap is made of polyamide (PA), polyethylene terephthalate (PET), polybutylene terephthalate (PBT) and/or polypropylene (PP), and/or a semicrystalline polymer and/or mixtures thereof.

The material of the inner core has a shrinkage rate upon cooling from 0.2% to 2.0%, more specifically from 0.8% to 2.0%, more specifically from 0.4% to 2.0%, more specifically from 0.4% to 1.5%.

Shrinkage rate refers to the shrinkage of a plastic part/component that is related to the thermal expansion and contraction properties of the plastic itself, the mold structure and the molding process conditions. The shrinkage rate of a plastic part can be expressed as:

$$S=[(a-b)/b]\times 100$$

where, a=injection mould cavity size under room temperature conditions b=part dimensions under room temperature conditions.

The shrinkage rate upon cooling may thus be measured for a specific part/component dimension by measuring the part/component dimension after contraction that takes place upon removal from the mould, the relevant cavity dimension and by using these two values as an input to the aforementioned equation, so as to calculate "S".

The soft outer layer may cover the outer surface of the inner core completely or by at least 80% or 90%, minimizing the risk of injuries in handling and even when the cap is being chewed on.

The outer layer is made of a hypoallergenic and/or biocompatible material, as often especially younger aged users tend to chew on the caps of writing instruments, exposing them to potentially harmful chemicals or risking injuries upon contact with the hard plastic inner core. The outer layer material is made of a material exhibiting shore A hardness value of less than 100. Such material is a soft material that minimizes risk of injury, in particular during chewing. The shore A hardness can be determined by measuring its value using a type A durometer in compliance with ASTM D2240. This material can be easily compressed and can show low resistance to indentation when load is applied. The outer layer may be made of silicone rubber. The outer layer may be made of a material having shore A hardness 20A to 80A, more specifically 30A to 50A.

The outer layer may further comprise an antimicrobial, antibacterial, antifungal and/or antiviral agent, to prevent microbial, fungal and/or viral growth and persistence in between uses. This ensures staining, bad odors and material degradation can be avoided or reduced, ensuring a longer lifetime of the product. The silicone rubber may be treated or coated with the respective antimicrobial, antibacterial, antifungal and/or antiviral agent, such as silver-based or polymer-based additives or coatings.

The cap may be manufactured by using a two-stage injection molding process, wherein in a first stage, plastic melt is injected in an inner core mold and solidified by cooling. In the second stage the inner core is overmoulded by injecting a liquid silicone rubber, i.e. a silicon rubber in liquid state, in a mold, in which the inner core has been placed. The liquid silicone rubber is then cured by external stimuli, such as high temperature or UV light.

BRIEF DESCRIPTION OF THE DRAWINGS

Additional details and features of the disclosure are described with reference to the following figures, in which.

DETAILED DESCRIPTION

Embodiments of the writing instrument according to the disclosure will be described with reference to the figures as follows.

Figure 1A:
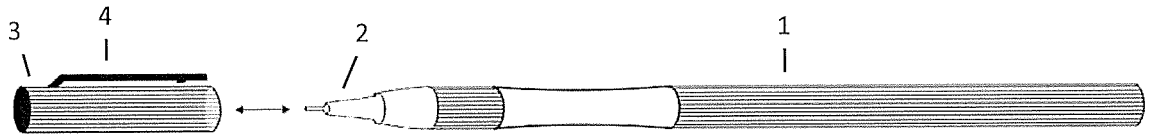
FIG. 1*a* shows a first embodiment of a writing instrument according to the present disclosure.
Figure 1B:
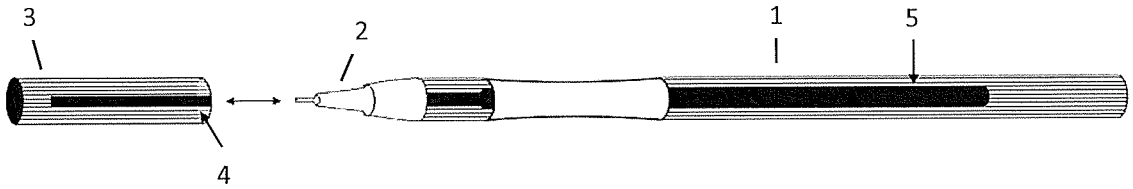
FIG. 1*b* shows another embodiment of a writing instrument according to the present disclosure.

FIG. 1*a* and FIG. 1*b* show a first embodiment of a writing instrument 1 comprising a main body, a writing tip 2 and a cap 3, wherein the cap 3 is designed to be secured tightly on the main body such that the writing tip 2 is covered by the cap 3. The cap may comprise a clip 4, to attach the writing instrument 1 to a suitable surface. The writing instrument 1 is further comprised of at least one cartridge 5 containing an ink, a colorant, or a mixture of ink or colorant and a solvent as shown in FIG. 1*b*. A ballpoint tip or a felt tip or a fountain tip or any type of tip such as pencil tip, graphene tip is forming the writing tip 2. The outer layer has the same color as the ink or colorant of the writing instrument 1, allowing an intuitive selection of the respective writing instrument.

Figure 2A:
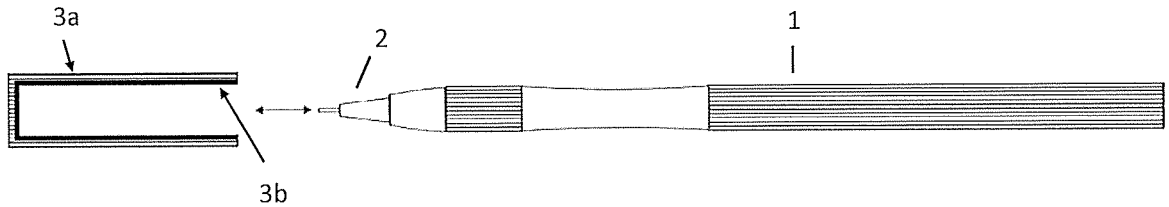
FIG. 2*a* shows an embodiment of a writing instrument with a cap comprised of two components.

FIG. 2*a* shows an embodiment of the writing instrument 1 with a cap 3 made of two components. The cap 3 comprises of an inner core 3*b* and an outer layer 3*a*, wherein a material of the outer layer is softer compared to a material of the inner core. The inner core of the cap 3*b* and the main body of the writing instrument are designed to form an air-tight or almost air-tight connection in order to encapsulate the writing tip 2, such that it prevents or reduces evaporation of the solvent, ink or colorant when volatile, as well as prevent breakage of the writing tip 2. This ensures the writing tip 2 is protected from drying and the evaporation of potentially harmful substances is prevented. As a result, a membrane within the cap to ensure air-tight sealing is not necessary.

Figure 2B:
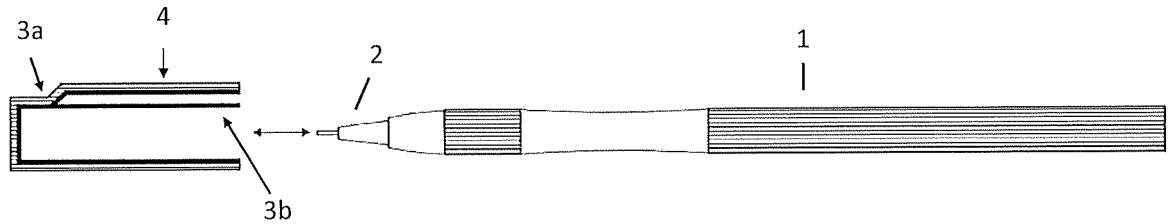
FIG. 2*b* shows an embodiment of a writing instrument with a cap including a clip, comprised of two components.

FIG. 2*b* shows an embodiment of the writing instrument 1 with a cap 3 made of two components and a clip 4 to attach the writing instrument 1 to a desired surface. The clip 4 is also comprised of an inner core 3*b* and an outer core 3*a*. Given this, the risk of injuries is reduced compared to an exposed hard plastic clip.

Figure 3A:
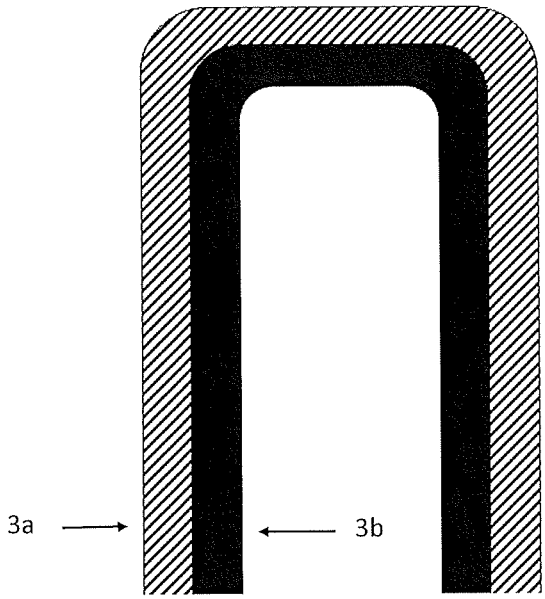
FIG. 3*a* shows an enlarged embodiment of a cap comprised of two components.
Figure 3B:
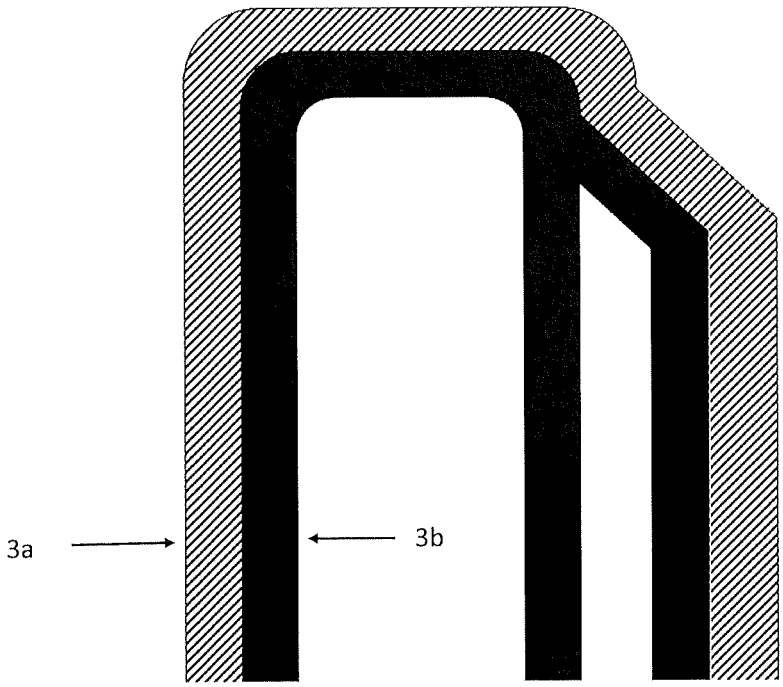
FIG. 3*b* shows an enlarged embodiment of a cap including a clip, comprised of two components.

FIGS. 3*a* and 3*b* show an enlarged embodiment of a cap 3 comprised of two components. A clip 4 may be added as shown in FIG. 3*b*. The inner core 3*b* of the cap 3 is made of a rigid plastic material, in particular a hard plastic, providing tight tolerances to seal with the main body of the writing instrument. The use of a hard plastic material as the inner core material of the cap of the writing instrument contributes to maintaining its dimensions during the manufacturing process and the conditions applied, as well as leading to the production of an inner core that is dimensionally determined and solid allowing firm attachment and/or sealing of the main body of the writing instrument. The material of the inner core 3*b* of the cap 3 is made of polyamide (PA), polyethylene terephthalate (PET), polybutylene terephthalate (PBT) and/or polypropylene (PP), and/or a semicrystalline polymer and/or mixtures thereof. The material of the inner core has a shrinkage rate upon cooling from 0.2% to 2.0%, more specifically 0.8% to 2.0%, more specifically 0.4% to 2.0%, more specifically 0.4% to 1.5%.

The outer layer 3*a* is made of a hypoallergenic and/or biocompatible material, as often especially younger aged users tend to chew on the caps of writing instruments, exposing them to potentially harmful chemicals or risking injuries upon contact with the hard plastic inner core 3*b*. The outer layer 3*a* material is made of a material having shore A hardness 20A to 80A, more specifically 30A to 50A. The outer layer 3*a* is made of silicone rubber.

The outer layer 3*a* further comprises an antimicrobial, antibacterial, antifungal and/or antiviral agent, to prevent microbial, fungal and/or viral growth and persistence in between uses. This ensures staining, bad odors and material degradation can be avoided or reduced, ensuring a longer lifetime of the product. The silicone rubber may be treated or coated with the respective antimicrobial, antibacterial, antifungal and/or antiviral agent(s), such as silver-based or polymer-based additives or coatings, more specifically silver-ion-based agents, copper-based agents or zinc pyrithione-based agents. With that it is possible to design a hygienic and tight-fitting cap 3, which even when chewed does not pose a health hazard. The soft material of the outer layer 3*a* covers the outer surface of the inner core 3*b* completely or by at least 80% or 90%, providing pleasant haptics and minimizing the risk of injuries in handling and even when the cap is being chewed on.

The cap is manufactured by using a two-stage injection molding process, wherein in a first stage, plastic melt is injected in an inner core mold and solidified by cooling. In the second stage the inner core is overmoulded by injecting liquid silicon rubber in a mold, in which the inner core has been placed. The liquid silicon rubber is then cured by external stimuli, such as high temperature or UV light. In embodiments, the liquid silicone rubber may be a UV-curing LSR. In some embodiments, two separate machines/molds may also be used for the two-stage injection molding process, achieving similar result. In particular, the plastic melt of the first stage is injected in an inner core and subsequently the inner core is transferred in a separate machine/mold, where the liquid silicone rubber is injected on top of it.

The invention claimed is:

1. A writing instrument comprising a main body, a writing tip and a cap, wherein the cap includes a clip, wherein the cap is designed to be secured on the main body such that the writing tip is covered by the cap, wherein the cap comprises an inner core and an outer layer, wherein a material of the outer layer is softer, and exhibits a shore A hardness value that is lower, compared to a material of the inner core, and the outer layer extending over a radially outermost surface of the clip.

2. A writing instrument according to claim 1, further comprising at least one cartridge containing an ink, a colorant, or a mixture of ink or colorant and a solvent.

3. A writing instrument according to claim 2, wherein the inner core of the cap and the main body of the writing instrument are designed to form an air-tight or almost air-tight connection in order to encapsulate the writing tip, such that it prevents or reduces evaporation of the solvent, ink or colorant when volatile.

4. A writing instrument according to claim 2, wherein the cartridge has a ballpoint tip or a felt tip or a fountain tip.

5. A writing instrument according to claim 2, wherein the outer layer exhibits a same color as the ink or colorant of the writing instrument.

6. A writing instrument according to claim 1, wherein the inner core of the cap is made of a plastic material.

7. A writing instrument according to claim 6, wherein the inner core of the cap is made of a hard plastic material, which hard plastic material is a semicrystalline polymer or mixtures thereof.

8. A writing instrument according to claim 1, wherein the inner core of the cap is made of a material having a shrinkage rate upon cooling from 0.8% to 2.0%.

9. A writing instrument according to claim 1, wherein the inner core of the cap is made of polyamide (PA), polyethylene terephthalate (PET), polybutylene terephthalate (PBT) and/or polypropylene (PP).

10. A writing instrument according to claim 1, wherein the outer layer covers the outer surface of the inner core completely or by at least 80% or 90%.

11. A writing instrument according to claim 1, wherein the outer layer is made of a material exhibiting shore A hardness value of less than 100 and the outer layer is made of a hypoallergenic and/or biocompatible material.

12. A writing instrument according to claim 11, wherein the outer layer is made of a material having shore A hardness 20A to 80A.

13. A writing instrument according to claim 12, wherein the outer layer is made of a material having shore A hardness 30A to 50A.

14. A writing instrument according to claim 1, wherein the outer layer is made of silicone rubber.

15. A writing instrument according to claim 1, wherein the outer layer further comprises one or more of an antimicrobial, antibacterial, antifungal, and an antiviral agent(s).

16. A writing instrument according to claim 1, wherein the cap is manufactured by using a two stage injection molding process, wherein in a first stage, plastic melt is injected in an inner core mold, and wherein in a second stage, liquid material is injected into a mold in which the inner core has been placed.

17. A writing instrument according to claim 1, wherein the outer layer is overmoulded.

18. The writing instrument according to claim 1, wherein the clip comprises an inner core and the inner core of clip comprises a harder material than the outer layer covering the clip.

19. The writing instrument of claim 18, wherein the clip extends away from the cap such that the inner core of the clip parallels the inner core of the cap without outer layer between the inner core of the clip and the inner core of the cap.

20. The writing instrument according to claim 1, wherein the radially inward surface of the clip is spaced apart from the remainder of the cap and is not in direct contact with the outer layer.

* * * * *